United States Patent [19]

Gustafsson

[11] Patent Number: 4,690,290

[45] Date of Patent: Sep. 1, 1987

[54] DEVICE OF THE KIND COMPRISING AT LEAST THREE MOVABLY CO-ORDINATED PARTS

[75] Inventor: Paul Gustafsson, Gavle, Sweden

[73] Assignee: AB Tico, Gavle, Sweden

[21] Appl. No.: 845,261

[22] PCT Filed: Jun. 10, 1985

[86] PCT No.: PCT/SE85/00243

§ 371 Date: Mar. 7, 1986

§ 102(e) Date: Mar. 7, 1986

[87] PCT Pub. No.: WO86/00607

PCT Pub. Date: Jan. 30, 1986

[30] Foreign Application Priority Data

Jul. 9, 1984 [SE] Sweden ..... 8403618

[51] Int. Cl.[4] ..... B66C 23/06

[52] U.S. Cl. ..... 212/267; 212/268; 212/269; 52/118

[58] Field of Search ..... 212/266, 267, 268, 269, 212/230, 231, 264; 52/111, 118, 119, 121

[56] References Cited

U.S. PATENT DOCUMENTS

| | | | |
|---|---|---|---|
| 3,836,011 | 9/1974 | Sakamoto et al. | 212/269 |
| 4,156,331 | 5/1979 | Lester et al. | 212/268 |
| 4,258,853 | 3/1981 | Gill et al. | 212/268 |
| 4,388,033 | 6/1983 | Pipes | 212/269 |
| 4,436,476 | 3/1984 | Yoritomi | 212/267 |
| 4,575,976 | 3/1986 | McDermott et al. | 212/269 |

FOREIGN PATENT DOCUMENTS

| | | | |
|---|---|---|---|
| 77717 | 4/1983 | European Pat. Off. | 212/267 |
| 44842 | 7/1968 | Finland | 212/267 |
| 8104099 | 1/1982 | Sweden | 212/267 |
| 429958 | 10/1982 | Sweden | 212/267 |

*Primary Examiner*—Jeffrey V. Nase
*Assistant Examiner*—Stephen P. Avila
*Attorney, Agent, or Firm*—William A. Drucker

[57] ABSTRACT

A device for providing relative movement between three telescopically co-ordinated parts (1, 2, 3) which comprises a power device (7) of a type variable in length and acting between a point (8) on a first (1) and a point (9) on a second (2) of the parts, and a flexible traction element (12), which is arranged to cause relative movement between the third part (3) and the first and said second parts (1, 2) by transmitting forces between the first and the third parts when relative movement between the first and second parts (1, 2) is effected by the power device. The power device located externally of the parts is designed with a longitudinal internal passage (13), in which the traction element extends in its extension between a point (14) on the third part and a point (15) fixed in relation to the first part (1), whereby the power device will operate as a casing variable in length for the traction element.

20 Claims, 2 Drawing Figures

DEVICE OF THE KIND COMPRISING AT LEAST THREE MOVABLY CO-ORDINATED PARTS

FIELD OF INVENTION AND PRIOR ART

This invention relates to a device for providing relative movement between at least three movably co-ordinated parts, comprising power means at least partly arranged externally of the parts, said power means being of a type variable in length and acting between a point on a first and a point on a second of the parts, and at least one at least partly flexible traction element extending between a point on the third part and a point fixed in relation to the first part and being arranged to cause relative movement between on one hand the third part and on the other hand said first and second parts by transmitting forces between the first and the third parts when relative movement between the first and second parts is effected by the power means, said traction element having a portion located externally of the parts when the parts are extended relative to each other.

Particularly, the invention relates to a telescopical co-ordination of the three parts. The device is primarily intended to be applied for obtaining a possibility of extension at a lifting crane, where the first part may constitute a pivotable arm of the crane while the third part has means for grasping/carrying an arbitrary load at the outer end.

A device of the kind defined in the introduction is previously known by FI-B 44842. However, this device has the draw back that the flexible traction element is uncovered externally of the parts. This causes a less successful result as regards the appearance and causes also the draw back that the traction element is exposed for contaminations and outer damages. It would be possible to arrange special proctection components for covering the exposed part of the chain but this would then cause increased expenses.

BRIEF DESCRIPTION OF THE INVENTION

The object of this invention is to devise a way to provide a casing for the portion of the flexible traction element lying externally of the parts in a practical and elegant way regarding the construction.

According to the invention this object is achieved in that said portion of the traction element located externally of the parts is received in a longitudinal internal passage in the power means variable in length, which thereby acts as a casing variable in length for said portion of the traction element.

Besides the advantage that the power means itself will function as a casing for the traction element, the advantage that the traction force will be transmitted centrally relative to the power means and via its connections is achieved. In an embodiment of the power means as a piston cylinder mechanism the arrangement of the inner passage in the mechanism will also lead to a relatively far-reaching uniformity what concerns the necessary pressure fluid volumes for obtaining a contraction of the mechanism as great as an expansion of the mechanism, whereby the velocity at the expansion and the contraction of the mechanism will be relatively alike. Further one achieves a compact embodiment by reception of the traction element within the power means.

BRIEF DESCRIPTION OF DRAWINGS

Referring to the appended drawings, below follows a closer description of an embodiment of the invention cited as an example.

In the drawings.

DETAILED DESCRIPTION OF PREFERRED EMBODIMENT

Figure 1:
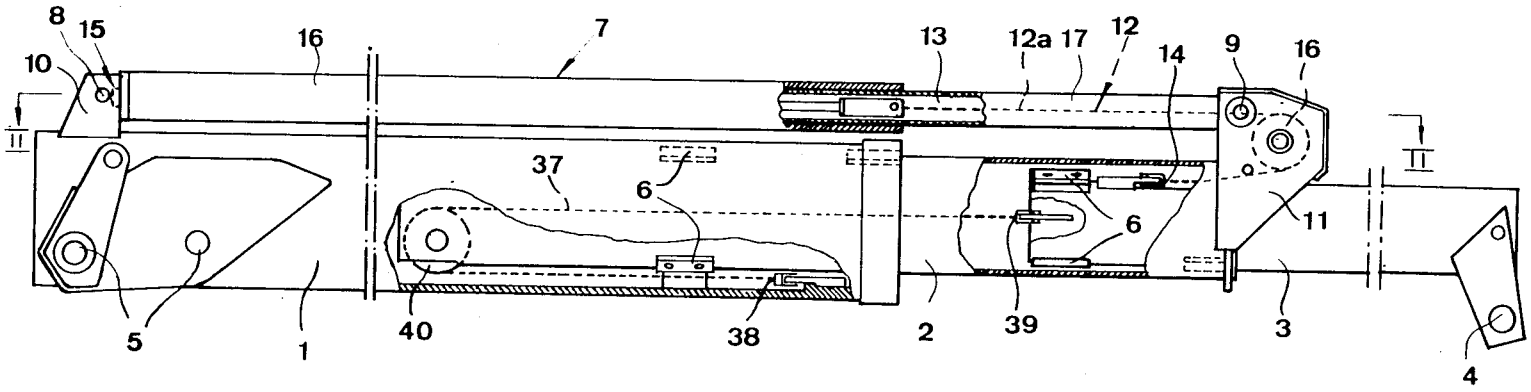
FIG. 1 is a partly cut view from the side of the device according to the invention.

The device illustrated in the drawings is intended for achieving a relative movement between at least three movably co-ordinated parts 1, 2, 3. These parts are preferably telescopically coordinated. Particularly, the second part 2 is received within the first part 1 while the third part 3 is received in the second part 2. In the example the parts 1–3 are intended to be included in a lifting crane and form an extensible outer arm to said crane while the outer end of the part 3 carries means 4 for connection of an arbitrary load. More exactly the part 1 presents means 5 for hinged connection of the part 1 to another crane arm comprised in the crane in question and to a power means such as a piston cylinder mechanism for pivoting the part 1 in the vertical plane relative to said further crane arm, whereby the part 1 constitutes the so called pivot arm of the crane.

The parts 1–3 are all tube shaped in cross section and are mutually journalled by means of conventional gliding liners 6 or the like.

A power means 7 variable in length acts between a point 8 on the first part and a point 9 on the second part 2. The points 8 and 9 are formed by conventional hinge connections, said connections being arranged at attachments 10 and 11 respectively applied on the parts 1 and 2. A flexible traction element 12 is arranged to cause extension also of part 3 from the part 2 by transmitting forces between the parts 1 and 3, at an extension of the part 2 from the part 1 caused by the power means 7.

The power means 7 arranged externally of the parts 1–3 is formed with a longitudinal internal passage 13, in which the traction element is running under its extension between a fastening point 14 on the part 3 and a point 15 fixed in relation to the first part 1. The traction element is more precisely running in a loop about a diverting member 16, e.g. a wheel, arranged on the attachment 11 fixed on the part 2. The diverting member 16 is arranged at the outer end of the part 2. More precisely the diverting member 16 is so arranged that the traction element between said diverting member 16 and the fastening point 14 on the part 3 extends substantially within the part 2 but externally of the part 3.

The connection point 9 of the power means 7 relative to the part 2 is so located in relation to the diverting member 16 that the traction element between the diverting member 16 and the point 15 may extend substantially in a straight line into and through the passage 13 within the power means, i.e. that a longitudinal center line of the passage 13 forms a tangent to the diverting member or -wheel 16 at the same time as the connection point 9 is located somewhat closer to point 15 than the symmetry axis of the diverting member.

The previously mentioned attachment 11 forms with advantage a casing, within which the diverting member 16 is located and which hides the traction element at its transfer from the interior of the part 2 via the diverting member 16 to the internal passage 13 in the power means 7. The traction element 12 will thus be substantially invisible from the outside of the device.

The power means is preferably constituted of a piston cylinder mechanism. Its cylinder 16 is connected to the point 8 while the piston rod 17 is connected to the point 9 since this gives a simpler design of the pressure fluid connections but also the opposite would in principle be possible.

The piston 18 and the piston rod 17 of the mechanism is axially recessed so that they obtain an annular and tube like form respectively for forming the internal passage 13.

Figure 2:
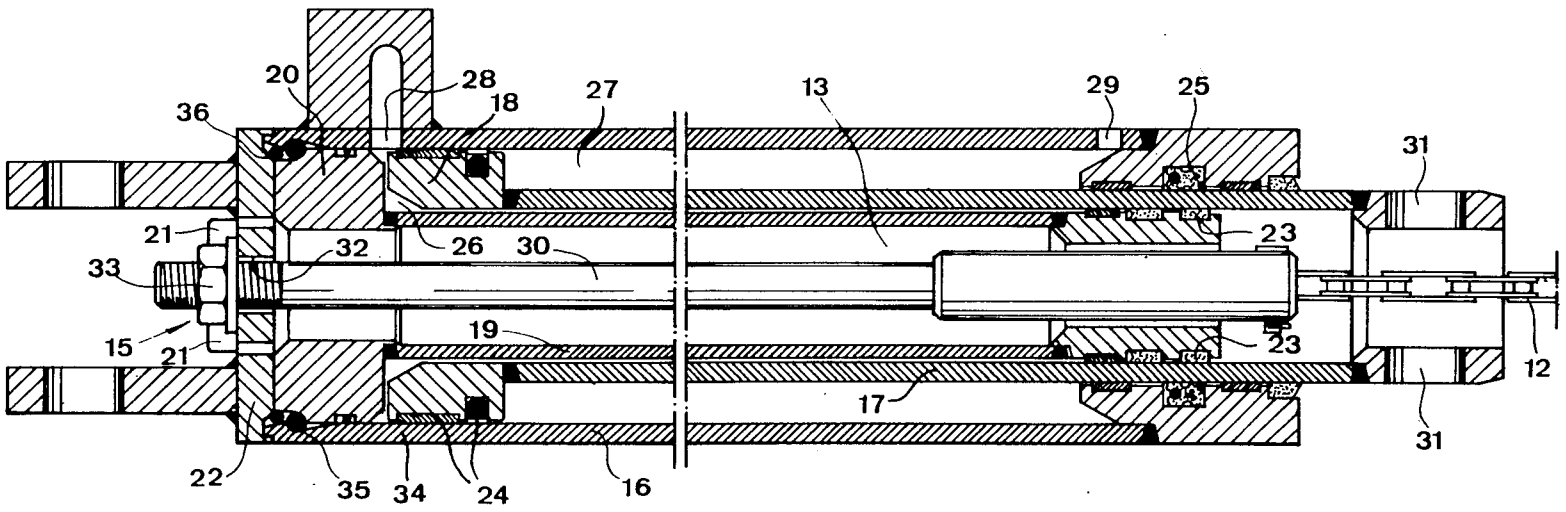
FIG. 2 is a longitudinal section of the power means of the device, viewed by itself along the line II—II in FIG. 1.

A tube shaped member 19 is fastened relative to the cylinder 16 of the mechanism at its inner end and extends through the piston 18 and into the piston rod 17. The tube shaped member 19 is more precisely fastened to an annular piece 20, which via screws 21 indicated in FIG. 2 is detachably fastened at the gable 22 of the cylinder. The tube shaped member 19 has outer sealing members 23 for co-operation with the inside of the piston rod 17 and arranged at its end closest to the cylinder end where the piston rod 17 exits from the cylinder. In a conventional way the piston 18 has sealing members 24 for sealing against the inner wall of the cylinder 16 while the cylinder has sealing members 25 for sealing against the outside of the piston rod 17 and arranged at the end opposite the gable 22. Thus, working spaces 26 and 27 are formed on mutual axial sides of the piston 18, which spaces via openings 28 and 29 can be supplied with and emptied of pressure fluid respectively.

The tube shaped member 19, (including the piece 20) and the piston rod 17 form together the internal passage 13, which extends substantially over the whole length of the mechanism. In FIG. 2 it is illustrated how the traction element 12 extends into the passage 13 via the right end of the piston rod and also how the traction element may have a portion 30 within the passage 13, which portion 30 is inflexible as it is constituted of a traction rod. The portion 30 may of course not be so long that there is a risk for interference with the diverting member 16, which thus always must be in engagement with a flexible portion 12*a* of the traction element 12. To enable the traction element to pass unimpededly into the passage 13 the connection point 9 is obtained by two separate stub axles extending into holes 31 in the piston rod in opposite directions and leaving a free space for the traction element 12 between each other.

The traction element 12 or more precisely its stiff portion 30 extends through an opening 32 in the gable wall 22 of the cylinder and co-operates with a member 33 for tensioning the traction element arranged on the outside of the gable wall 22. The member 33 may be constituted of a nut in engagement with a thread on the end of the rod 30.

To get an easy possibility to dismount the mechanism, its cylinder 16 is formed of two components detachable from each other, viz. on one hand a component comprising the gable 22 and on the other hand a component comprising the jacket 34. These two components are connectable relative to each other by means of the screws 21 and the piece 20, which is so designed in combination with the jacket tube 34 that tightening of the screws 21 by a sealing and axial pressure transferring annular member 35 gives rise to pressing of the gable 22 and the jacket 34 against each other. A further sealing element 36 in form of a ring may be arranged in the boundary zone between the gable 22 and the jacket 34. However, as soon as the nut and the screws have been loosened the gable 22 can be separated from the jacket 34 and then the assembly 19/20 and assembly 17/18 may be drawn out through the opening uncovered by the gable 22.

A second flexible traction element 37 is arranged to draw the part 3 into the part 2, when the part 2 is drawn into the part 1 by means of the mechanism 7. The traction element 37 extends more precisely between a point 38 in the proximity of the outer end of the part 1 and a point 39 on the part 3. Between the points 38 and 39 the traction element 37 extends in a loop about a diverting member 40 arranged at the inner end of the part 2, said traction element 37 extending within the part 2 between the diverting member 40 and the point 39 on the part 3, and within the part 1 but outside the part 2 between the diverting member and the point 38 on the part 1.

In expansion of the mechanism 7 it will directly bring the part 2 to extend out of the part 1. Simultaneously the mechanism 7 will via the diverting member 16 actuate the traction element 12 so that a traction force is obtained which displaces the part 3 out of the part 2. Concerning the point 15 it can here be interposed that it is sufficient that it is "fixed" in the sense that it forms an abutment for traction forces in the traction element 12; since a certain tension normally exists in the traction element 12 there is in principle nothing preventing the traction element from being displaced in the passage 13 in a direction towards the left in FIG. 2. In contraction of the mechanism 7 the part 2 will as a consequence of direct actuation of the mechanism 7 be displaced into the part 1 simultaneously as the traction element 37 is subjected to a traction force causing the part 3 to be drawn into the part 2.

The advantages of the device according to the invention are several: The reception of a traction element 12 within the mechanism 7 results in a concealed location of the traction element. Moreover the device gives a synchronous extension and contraction of the parts 2 and 3 from and into the parts 1 and 2 respectively. An advantage with the described design of the mechanism 7 is further that the location of the tube shaped portion 19 within the piston rod 17 and the piston 18 will result in a relatively small difference in volume when extending and contracting the mechanism a predetermined distance; the difference in volume will substantially depend on the volume the tube shaped piston rod 17 is occupying along the work space 27. Despite the concealed location of the traction element 12 within the mechanism 7 it is easy to perform adjustment of the tension of the traction element by means of the adjustment member 33 available externally of the cylinder.

It is obvious that the invention not only is limited to the illustrated embodiment. As an example it is possible to fasten the traction element 12 to a portion of the mechanism 7 within its cylinder and/or piston rod, said portion being fixedly arranged in relation to the part 1. Thus, it is not at all necessary that the passage 13 extends along the whole mechanism 7. However, as an alternative the traction element could extend freely straight through the mechanism 7 and be fastened directly to the part 1 outside the mechanism. Further it would be possible to use a screw/nut mechanism with a longitudinal passage through the screw and/or the nut as a power means variable in length. Further it may be cited that although traction elements 12, 37 in form of chains at times may be preferable also other flexible traction elements such as lines, wires or the like are possible to use. As diverting members 16, 40 it is also possible to use other components than diverting wheels or -rolls.

I claim:

1. A device for providing relative movement between at least three movably co-ordinated parts (1, 2, 3), comprising: first, second and third co-ordinated parts, power means (7) at least partly arranged externally of the parts, said power means (7) being variable in length and acting between a point (8) on a first (1) and a point (9) on a second (2) of the parts, and at least one partly flexible traction element (12) extending between a point (14) on the third part (3) and a point (15) fixed in relation to the first part (1) and being arranged to cause relative movement between the third part (3) and said first and second parts (1, 2) by transmitting forces between the first and the third parts when relative movement between the first and second parts (1, 2) is effected by the power means, said traction element (12) having a portion (12*a*) located externally of the parts when the parts are extended relative to each other, characterized in that said portion (12*a*) of the traction element (12) located externally of the parts (1, 2, 3) is received in a longitudinal internal passage (13) in the power means (7), which thereby acts as a casing which is variable in length for said portion (12*a*) of the traction element (12).

2. A device according to claim 1, characterized in that the parts are telescopically coordinated in such a way that the second part (2) is received in the first part (1) while the third part is received in the second part (2).

3. A device according to claim 1, characterized in that the traction element extends in a loop about a diverting member (16) arranged on the second part (2), preferably at the end of the traction element facing away from the first part (1), so that the traction element (12) displaces the third part (3) from the second part (2) when the first and second parts are displaced from each other by means of the power means.

4. A device according to claim 2, characterized in that the traction element extends within the second part (2) between the diverting member (16) and said point (14) on the third part (3).

5. A device according to claim 4, characterized in that the diverting member (16) is located in a casing (11), which conceals the traction element (12) in its transfer from the interior of the second part (2) via the diverting member (16) to the internal passage (13) in the power means (7).

6. A device according to claim 1, characterized in that the power means (7) is constituted of a piston cylinder mechanism including a piston and a piston rod.

7. A device according to claim 6, characterized in that the piston (18) and the piston rod (17) of the mechanism is axially recessed for forming said internal passage (13), that a tube shaped member (19) is fastened relative to the cylinder of the mechanism at its inner end and extends through the piston and into the piston rod, and that the tube shaped member (19) has sealing means (23) for co-operation with the inside of the piston rod (17) at the end of the tube shaped member closest to the end of the cylinder where the piston rod exits from the cylinder.

8. A device according to claim 7, characterized in that the tube shaped member (19) and the piston rod (17) together form the internal passage (13), which extends substantially over the whole length of the mechanism.

9. A device according to claim 8, characterized in that the traction element (12) extends through an opening (32) in the gable wall (22) of the cylinder and co-operates with a member (33) arranged on the outside of said gable wall for tensioning the traction element.

10. A device according to claim 2, characterized in that a second flexible traction element (37) is arranged to draw the third part (3) into the second part (2) when the second part (2) is drawn into the first part (1) by means of the power means (7), that the second traction element (37) between a point (38) at the outer end of the first part (1) and a point (39) on the third part (3) extends in a loop about a second diverting member (40) arranged at the inner end of the second part (2), said second traction element (37) extending within the second part between the second diverting member (40) and the third part (3), and within said first part but outside the second part (2) between the second diverting member (40) and the first part.

11. A device according to claim 2 characterized in that the traction element extends in a loop about a diverting member (16) arranged on the second part (2), preferably at the end of the traction element facing away from the first part (1), so that the traction element (12) displaces the third part (3) from the second part (2) when the first and the second parts are displaced from each other by means of the power means.

12. A device according to claim 3 characterized in that the traction element within the second part (2) between the diverting member (16) and said point (14) on the third part (3).

13. A device according to claim 11 characterized in that the traction element extends within the second part (2) between the diverting member (16) and said point (14) on the third part (3).

14. A device according to claim 13 characterized in that the diverting member (16) is located in a casing (11), which conceals the traction element (12) in its transfer from the interior of the second part (2) via the diverting member (16) to the internal passage (13) in the power means (7).

15. A device according to claim 14 characterized in that the power means (7) is constituted of a piston cylinder mechanism including a piston and a piston rod.

16. A device according to claim 15 characterized in that the piston (18) and the piston rod (17) of the mechanism is axially recessed for forming said internal passage (13), that a tube shaped member (19) is fastened relative to the cylinder of the mechanism at its inner end and extends through the piston and into the piston rod, and that the tube shaped member (19) has sealing means (23) for co-operation with the inside of the piston rod (17) at the end of the tube shaped member closest to the end of the cylinder where the piston rod exits from the cylinder.

17. A device according to claim 16 characterized in that the tube shaped member (19) and the piston rod (17) together form the internal passage (13), which extends substantially over the whole length of the mechanism.

18. A device according to claim 17 characterized in that the traction element (12) extends through an opening (32) in the wall (22) of the cylinder and co-operates with a member (33) arranged on the outside of said wall for tensioning the traction element.

19. A device according to claim 3 characterized in that a second flexible traction element (37) is arranged to draw the third part (3) into the second part (2) when the second part (2) is drawn into the first part (1) by means of the power means (7), that the second traction element (37) between a point (38) at the outer end of the first part (1) and a point (39) on the third part (3) extends in a loop about a second diverting member (40) arranged at the inner end of the second part (2), said second traction element (37) extending within the second part between the second diverting member (4) and the third part (3), and within said first part but outside the second part (2) between the second diverting member (4) and the first part.

20. A device according to claim 11 characterized in that a second flexible traction element (37) is arranged to draw the third part (3) into the second part (2) when the second part (2) is drawn into the first part (1) by means of the power means (7), that the second traction element (37) between a point (38) at the outer end of the first part (1) and a point (39) on the third part (3) extends in a loop about a second diverting member (40) arranged at the inner end of the second part (2), said second traction element (37) extending within the second part between the second diverting member (4) and the third part (3), and within said first part but outside the second part (2) between the second diverting member (4) and the first part.

* * * * *